US005720044A

United States Patent [19]

Robinson

[11] Patent Number: 5,720,044

[45] Date of Patent: Feb. 24, 1998

[54] REVERSIBLE SHIRT WITH CUTOUT SECTION FOR COOLING

[76] Inventor: James Robinson, 13820 SW. Electric St., Space 212, Beaverton, Oreg. 97005

[21] Appl. No.: 726,671

[22] Filed: Oct. 7, 1996

[51] Int. Cl.[6] ..... A41B 1/00

[52] U.S. Cl. ..... 2/77; 2/115; 2/69

[58] Field of Search ..... 2/77, 69, 113, 2/115, 108, DIG. 1

[56] References Cited

U.S. PATENT DOCUMENTS 3,618,139 11/1971 Hugin ..... 2/115

4,541,129 9/1985 Murakami ..... 2/113

5,033,118 7/1991 Lincoln ..... 2/115

*Primary Examiner*—Gloria Hale

*Attorney, Agent, or Firm*—William A. Birdwell & Associates

[57] ABSTRACT

A shirt or shirt-like garment having a large cutout section in the torso is constructed in the neck and shoulder region so as to be symmetric across a plane passing laterally therethrough, whereby the "fit" of the shirt is the same whether put on "frontwards" or "backwards." As a consequence, the same shirt or shirt-like garment can be worn in one disposition with the cutout region in the front for cooling and the back covered for protection against the sun, or in the opposite disposition.

8 Claims, 2 Drawing Sheets

Fig. 1
*PRIOR ART*
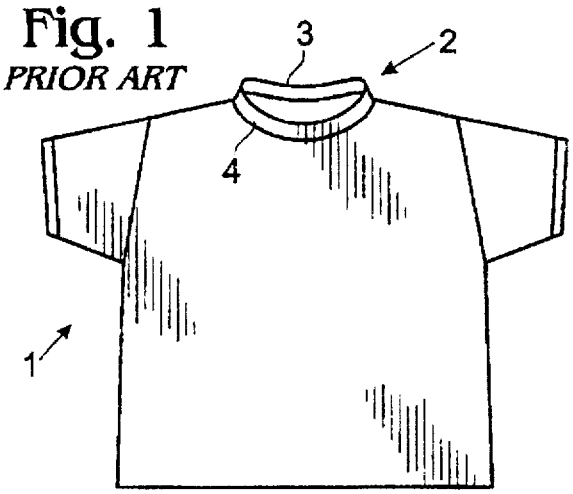
Fig. 3
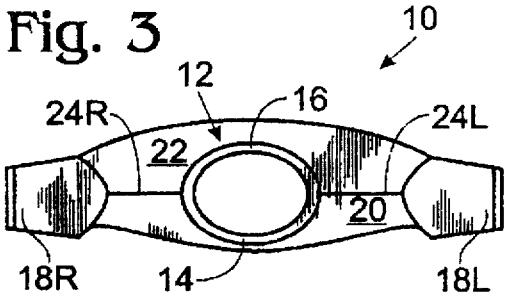
Fig. 2b
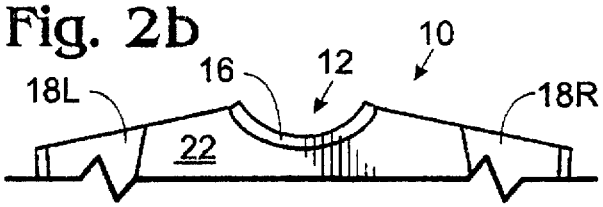
Fig. 2a
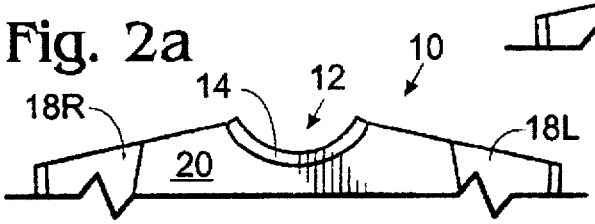
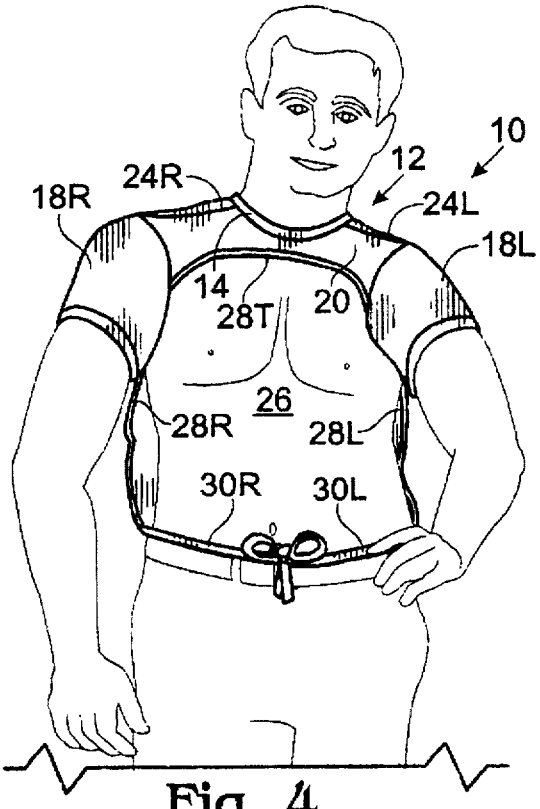
Fig. 4
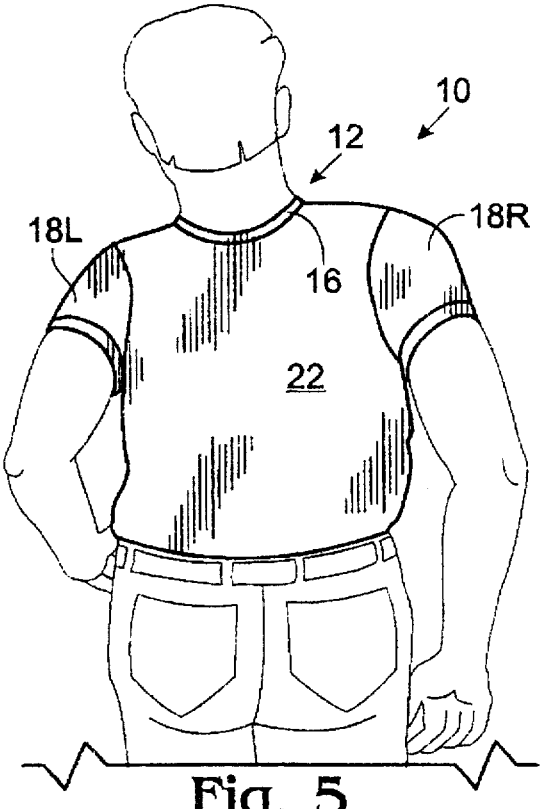
Fig. 5

Fig. 6a
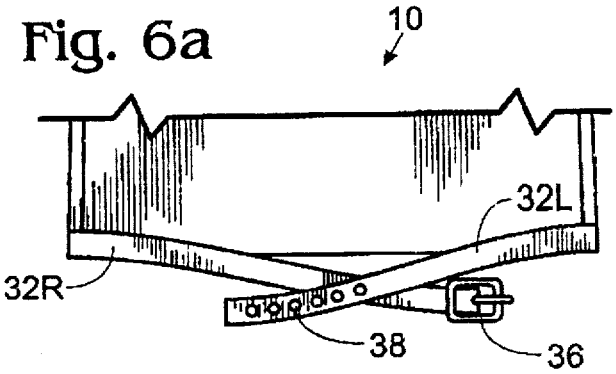
Fig. 6b
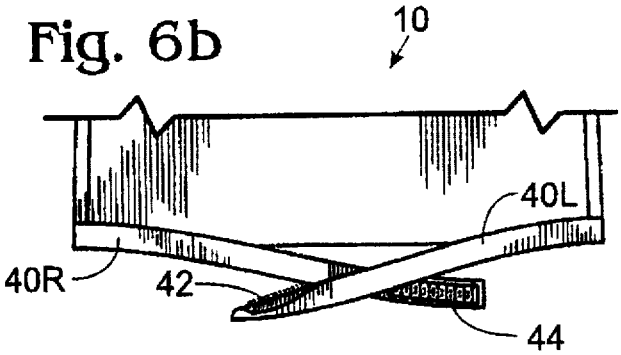
Fig. 7
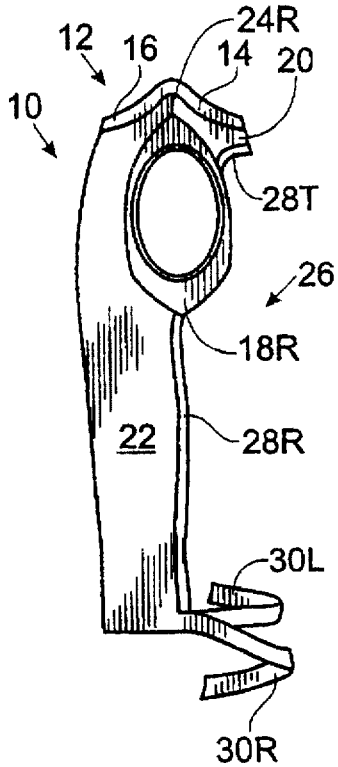
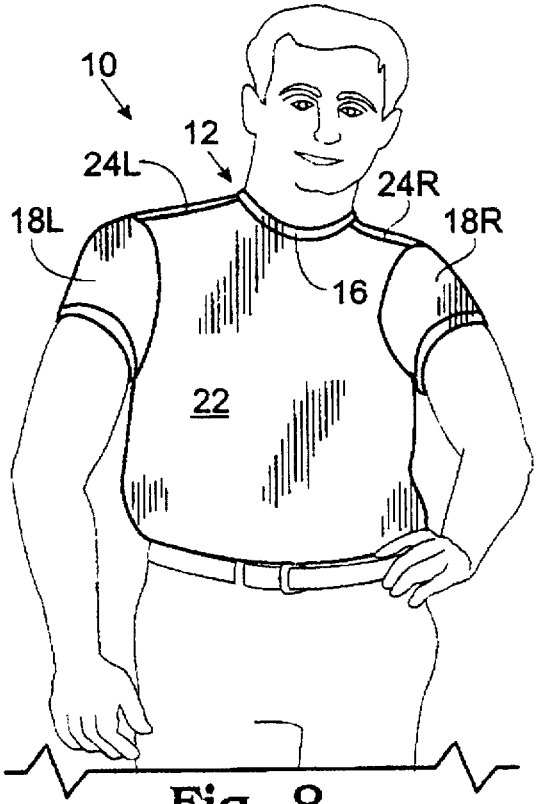
Fig. 8
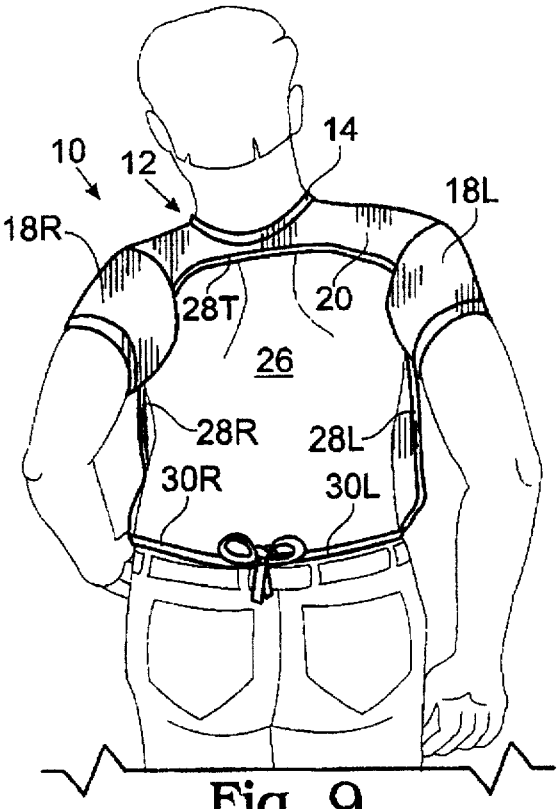
Fig. 9

REVERSIBLE SHIRT WITH CUTOUT SECTION FOR COOLING

BACKGROUND OF THE INVENTION

1. Field of the Invention

This invention relates to wearing apparel, and particularly to shirts having a cutout section defined therein for cooling purposes, the present shirt also being reversible so as to provide without discomfort such a cutout section either on the front or the back of the torso.

2. Background Information

For outdoor use, it is often desirable to be able to wear a shirt that provides protection from the sun but yet provides cooling as well. Various designs of shirts that will cover the sun-exposed back of a wearer but yet leave the front cutout for cooling purposes have been shown, e.g., in U.S. Pat. No. Des. 214,356 issued Jun. 10, 1969 to Jarrett, and U.S. Pat. No. Des. 305,826 issued Feb. 6, 1990 to Langford, Ill.

Similar cooling efforts have been sought in various utility patents, e.g., in the protective garment shown in U.S. Pat. No. 5,293,646 issued Mar. 15, 1994 to Winston that essentially comprises a planar fabric material that is manipulated onto the body; or the one-piece blouse of U.S. Pat. No. 2,603,788 issued Jul. 22, 1952 to Page that can be fastened down the front by hook-and-eye devices. Of these particular garments, only the Jarrett shirt has a defined collar region for encircling the neck, and from FIG. 1 below it may be seen that in accordance with conventional shirt design, the collar band placement is asymmetrical with regard to front and back, i.e., the rearward curve of the collar band (adapted to fit the back of the neck) is raised higher than the frontward curve of the collar band (adapted to fit the front of the neck). Such a shirt is not adapted for wearing in a front-to-back reversal, as is known to anyone who has inadvertently put on a conventional T-shirt "backwards": the collar band presses the neck in the front, causing discomfort.

Another feature of conventional shirt design is seen in U.S. Pat. No. 3,618,139 (which provides an open front region) issued Nov. 9, 1971 to Hugin and in U.S. Pat. No. 3,158,872 (which is open both front and back, being intended to be worn under another garment) issued Dec. 1, 1964 to Pantzke, namely, an asymmetrical structure within the shoulder regions to yield a broader region in the back relative to the front, thereby to accommodate the curvature of the shoulder. Although both of such shirts also incorporate collars having wings that would inhibit wearing the shirt in a reverse front-to-back disposition in any event, nevertheless the aforementioned shoulder structure would likewise inhibit such usage, inasmuch as the narrower front shoulder material thus being placed to the rear would likely need to be stretched out somewhat, and similarly the broader rear shoulder material could "bunch up" along the narrower front. The "Separable Ventilated Athletic Jacket" of U.S. Pat. No. 5,201,075 issued Apr. 13, 1993 to Svetich has a similarly asymmetric shoulder structure.

The "All Weather Garment System" of U.S. Pat. No. 5,088,116 issued Feb. 18, 1992 to Gould has a shoulder structure (i.e., a "yoke") in which front and back as such are undefined, but such definition is made both by the structure of the collar region thereof and in the manner in which various removable components, including a hood and various protective panels, are to be attached.

Another garment that is designed to present the appearance of being worn not reversibly (i.e., put on either frontwards or backwards) but "inside out" is shown in U.S. Pat. No. 4,078,265 issued Mar. 14, 1978 to Condit. Such an apparent change is not actually accomplished, it being intended only to provide the appearance of such a change by means of moving a distinctively marked panel from front to back, or oppositely, thereby to alter the outward appearance of the garment for identification purposes (e.g., for distinguishing one "team" from another in a game).

As opposed to the foregoing garments, it would be useful to provide a shirt or the like that had a cutout section therein for cooling purposes, but yet such garment could be put on in a disposition that was switched from front to back. For example, when being outdoors for work or other purposes, it could be important to protect the back against sunburn while at the same time leaving the front of the torso open for ventilation. Conversely, when cooking at a hot stove, it could be important to protect the front of the torso from the heat of the stove while leaving the back open for cooling. In yet another instance, a person working outdoors may have need to enter a restaurant for a meal, but would not be admitted while having a cutout torso, and in that case the person wearing such a reversible garment along with, perhaps, an unbuttoned windbreaker, could reverse that undergarment so as to cover the front of the torso, put the windbreaker back on, and thus appear to be fully clothed for the purposes of the restaurant. In a similar fashion, a lady who working alone in a garden and was perhaps wearing only a brassiere along with such a reversible garment on her upper body could maintain the cutout region in the front while working alone in the sun, but then reverse the garment so as to cover the front of the torso upon returning to the company of others. In these and similar circumstances, it would be useful to have a shirt-like garment that would provide a cutout section for cooling purposes either on the front or the back of the garment, and could be worn comfortably in either disposition. Preferably, such a garment could be reversed without requiring complete removal thereof, as by removing only the arms, rotating the garment about the torso, and then reinserting the arms.

SUMMARY OF THE INVENTION

The invention comprises a shirt-like garment having a cutout section encompassing a major portion of one side of the human torso, which is further adapted so that such cutout section may be disposed either on the front or the back of the torso. Both the collar band and shoulder structure (i.e., the "yoke") are constructed in a manner that is symmetric with respect to a plane that passes transversely between front and back thereof, whereby the front and back become indistinguishable and the garment can be worn with equal comfort in either disposition.

BRIEF DESCRIPTION OF THE DRAWINGS

The preferred embodiments of the invention will now be described in detail with reference to the accompanying drawings, in which:

FIG. 1 shows in front elevation a "T-shirt" from the prior art which illustrates the conventional asymmetric structure of a neck band.

FIGS. 2*a* and 2*b* show in front and rear elevation views respectively an upper portion of a preferred embodiment of the invention, wherein the neck band is front-to-back symmetric.

FIG. 3 shows a top plan view of the garment of FIGS. 2*a*, 2*b*, showing again the symmetric structure of the neck band and also the front-to-back symmetric structure of the shoulder region ("yoke").

FIG. 4 shows a front view of the garment of FIGS. 2a, 2b being worn with a cutaway section thereof being placed to the front, together with connecting bands at the bottom thereof.

FIG. 5 shows a rear view of the garment of FIG. 4.

FIGS. 6a and 6b show alternative buckle and hook connecting bands.

FIG. 7 shows a side elevation view of the garment of FIG. 4.

FIG. 8 shows the garment of FIG. 4 being worn by a subject in the opposite front-to-back disposition to that of FIG. 4, the subject being shown from the front.

FIG. 9 shows the garment of FIG. 8 wherein the subject is shown from the back.

DETAILED DESCRIPTION OF THE INVENTION

In the conventional manner of shirt construction, accommodation is made for the asymmetric structure of the human neck and shoulders, in the sense that the juncture between the neck and shoulders tapers downwardly from back to front. Thus, in prior art T-shirt 1 shown in FIG. 1, in neck band 2, rearward portion 3 thereof is raised higher than frontward portion 4, so that when T-shirt 1 is put on, rearward portion 3 touches the body near the large atlas bone of the spine, whereas frontward portion 4 touches the body at a lower position near the collar bones. Such a design provides greater fit and comfort when T-shirt 1 is worn as intended, but that same design precludes proper fit and comfort should T-shirt 1 be put on "backwards," in the front-to-back sense, e.g., rearward portion 3 in such case will "ride" uncomfortably up on the front of the neck. Conventional shirts such as T-shirt 1 are thus not adapted to be worn "reversibly," in the front-to-back sense, and noticeable discomfort is experienced upon putting on such a shirt "backwards."

For reasons to be noted hereinafter, it is advantageous to provide a T-shirt or the like in which such discomfort will not occur when wearing a shirt "backwards." With reference only to the aforementioned structure of the neck band, FIG. 2a shows in front elevation a portion of a preferred embodiment of the invention as T-shirt 10 wherein, as a feature of neck band 12, he rearward portion thereof is not visible in the drawing inasmuch as it lies at a height even with and is covered up in the drawing by frontward portion 14, which in FIG. 2a is visible. Conversely, FIG. 2b shows T-shirt 10 in rear elevation, and in this case rearward portion 16 can be seen but frontward portion 14 cannot, i.e., frontward portion 14 and rearward portion 16 are at the same height so that FIGS. 2a and 2b appear identical insofar as concerns the structure of neck band 12. When donning such a shirt in either of the dispositions of FIGS. 2a or 2b, that one of either of frontward portion 14 or rearward portion 16 that comes to be placed on the back of the neck will not rise as far up the spine as would occur with a conventional T-shirt when donned properly (front to back), but because of their lower disposition, neither frontward portion 14 nor rearward portion 16, as the case may be, will rise uncomfortably up on the front of the neck. T-shirt 10 in FIGS. 2a, 2b also incorporates tubular sleeves 18L and 18R ("L" and "R" respectively designating "left" and "right") on opposite sides thereof for entry of the arms, sleeves 18L and 18R being attached on opposite sides of both front panel 20 and rear panel 22, with the center portions of the upper ends of front and rear panels 20, 22 being curved so as to attach respectively to frontward portion 14 and rearward portion 16 of collar band 12.

A second feature of the conventional T-shirt is found in the structure of the shoulder region, or "yoke." Conventional T-shirts are often formed in part from either a tube of fabric, or else from two panels of fabric that have been sewn together along the sides thereof to form such a tube, but in either case having either two such panels or two corresponding tube sections respectively adapted to cover the front and the back of the torso. In the shoulder region, the "rearward" one of those sections or panels typically extends further upward than the frontward section or panel, precisely so as to accommodate rearward portion 3 of asymmetric neck band 2 of FIG. 1. The second feature mentioned above is found in the manner in which the two panels or tube sections are structured at upper ends thereof so as to pass over the shoulders.

Specifically, because of the greater upward extension in the prior art T-shirt of FIG. 1 of the rearward panel or tube section in comparison with the frontward panel or tube section, the upwardly extending lengths of the two panels or tube sections are often joined at a seam that is also asymmetric in a front-to-back sense, such joinder being typically made along a line that is nearly tangential to the furthest rearward extension of the neck band. As a consequence, when the shirt is worn in the intended front-to-back disposition the seam so produced generally lies across the rearward part of the shoulders. Since the lateral span of the rearward part of the human shoulders is somewhat broader than the lateral span of the frontward part thereof, the width of such a conventional shirt between the orifices for the sleeves may be made wider in that rearward part than in the frontward part. In addition to the "riding up" of the neck band if such a shirt is put on backwards, therefore, the shirt may also become excessively stretched in its front section if that section is in fact placed across the back of the shoulders, while conversely the broader expanse of the backward section will become wrinkled or "bunched up" if placed across the front of the shoulders. For purposes of providing reversibility, therefore, it is likewise advantageous to form a T-shirt or the like that is also symmetric as between the front and back sections thereof with respect to the width of fabric lying between the orifices for the sleeves.

Such a design is shown in the top plan view of T-shirt 10 shown in FIG. 3, which again shows collar band 12, in this case both frontward portion 14 and rearward portion 16, sleeves 18R and 18L, and front and rear panels 20, 22. Front panel 20 is clearly distinguishable in another respect that will be explained below, but for the present it may be noted that insofar as concerns the interconnection of front and rear panels 20, 22 as well as sleeves 18R and 18L and collar band 12, such structure is symmetric with respect to a plane passing laterally therethrough, i.e., through left and right shoulder seams 24L and 24R. For purposes of the structure that is ultimately formed, it is not essential that shoulder seams 24L and 24R indeed lie within that plane, i.e., front and rear panels 20, 22 could be modified in length so that the one was made shorter by an amount equal to that in which the other was made longer, which would thereby shift the location either frontwards or backwards of the seam by which the two are interconnected in the vicinity of collar band 12, but for manufacturing purposes it is advantageous to make the upper structures of front and rear panels 20, 22 to be identical so as to permit working from a single pattern.

Front and rear panels 20, 22 are distinguishable, however, firstly in that front panel 20 is characterized by having therewithin a relatively large "cutout" 26 from which material has been removed in the approximate shape of an inverted "U," as is shown in FIG. 4, wherein T-shirt 10 is shown from the front as being worn by a subject. In FIG. 5, T-shirt 10 is shown from the back as being worn by that same subject. As so worn, T-shirt 10 protects the subject from sunburn on the back, while the front of the torso is exposed for cooling purposes. For purposes of preventing unraveling or the like, the edges of the "remaining" portions of front panel 20 at the periphery of cutout 26 are preferably bounded by left, right, and top hems 28L, 28R and 28T. It is of course not necessary that front panel 20 actually be formed by the removal of material in the shape of cutout 26 from a previously "complete" panel of material, such terminology being used only for descriptive purposes.

For purposes of preventing rear panel 22 from flying about, front panel 20 further includes bands 30L and 30R respectively attached to lower left and lower right inner corners of front panel 20 in a mutually facing disposition to as to permit extension across the bottom thereof and interconnection, e.g., as by tying together mutually facing ends of bands 30L and as is shown in FIG. 4. FIGS. **6*a* and 6*b* illustrate alternative methods of interconnecting such bands, i.e., buckle bands 32L and 32R of FIG. 6*a* incorporate a conventional buckle (36)-and-hole (38) arrangement at respective ends thereof, whereas hook bands 40L and 40R of FIG. 6*b* incorporate a conventional hook(42)-and-pile-(44**) arrangement such as that known under the trade name "Velcro" at respective ends thereof. Other essentially equivalent arrangements such as by using snaps or the like may also be employed.

For further clarification, FIG. 7 shows a side elevation view of T-shirt 10, with like numbers thereon corresponding to like elements of the previous drawings, the example of bands 30L and 30R being employed but it being understood that alternative buckle bands 32L and 32R or hook bands 40L and 40R or other equivalents might also be employed. Again using like numbers for like elements, FIGS. 8 and 9 respectively show front and back views of T-shirt 10 as being worn by a subject in the reverse disposition from that of FIGS. 4 and 5, whereby cutout 26 has been disposed on the back of the subject while the front of the torso is covered, e.g., for protection from heat while cooking at a hot stove while leaving the back open for cooling purposes. In view of the symmetric structure of T-shirt 10 in the region of the neck and shoulders as previously described, the "fit" of T-shirt 10 in such regions is the same in either of such "reversible" dispositions.

It will be understood by those of ordinary skill in the art that other arrangements and disposition of the aforesaid components, the descriptions of which are intended to be illustrative only and not limiting, may be made without departing from the spirit and scope of the invention, which must be identified and determined only from the following claims and equivalents thereof.

I claim:

1. A shirt for clothing a wearer, comprising:

a first torso covering portion having elevational dimensions substantially corresponding to the elevational dimensions of the wearer's torso, said first torso portion including a first neck cutout area: and a second torso covering portion having elevational dimensions which are substantially identical to the elevational dimensions of said first torso covering portion, said second torso portion including a second neck cutout area and a cooling cutout, said first torso covering portion and said second torso covering portion meeting so that said first neck cutout area and said second neck cutout area form a neck opening for the wearer's neck, half of said neck opening being formed by said first neck cutout area and a substantially identical half of said neck opening being formed by said second neck cutout area, so that the relationship between the wearer's neck and said neck opening is substantially unchanged with respect to whether the shirt is worn so that said first torso covering portion covers the from of the wearer's torso and said second torso covering portion covers the back of the wearer's torso, or the reverse.

2. The shirt of claim 1, wherein said first torso covering portion and said second torso covering portion meet at a yoke corresponding to the area of the wearer's shoulders, said yoke including said neck opening, wherein said yoke includes a seam of joinder of said first and said second torso covering portions, wherein said seam forms a line that substantially bisects said neck opening.

3. The shirt of claim 2, wherein said cutout includes substantially all of the second torso covering portion below said yoke portion.

4. The shirt of claim 1, wherein said first torso covering portion and said second torso covering portion meet at least one sleeve portion forming an opening for at least one of the wearer's arms, wherein half of said sleeve portion is associated with said first torso covering portion and a substantially identical half of said sleeve portion is associated with said second torso covering portion, so that the relationship between the wearer's arm and said sleeve portion is substantially unchanged with respect to whether the shirt is worn so that said first torso covering portion covers the front of the wearer's torso and said second torso covering portion covers the back of the wearer's torso, or the reverse.

5. The shirt of claim 4, wherein said first torso covering portion includes spaced elongate tying portions, said tying portions having free ends adapted to removably couple to one another, said tying portions having a length so that said tying portions are adapted to substantially encircle the wearer's waist and so that said free ends substantially meet one another to achieve said coupling.

6. The shirt of claim 5, wherein said free ends are adapted to tie together.

7. The shirt of claim 5, wherein said free ends include respective hook and loop fasteners.

8. The shirt of claim 5, wherein said free ends include a respective buckle and hole.

* * * * *